US005533449A

United States Patent [19]

Hasegawa et al.

[11] Patent Number: 5,533,449

[45] Date of Patent: Jul. 9, 1996

[54] MOTOR-TYPE INK SENSOR

[75] Inventors: Takanori Hasegawa; Hideo Shoji, both of Tokyo, Japan

[73] Assignee: Riso Kagaku Corporation, Tokyo, Japan

[21] Appl. No.: 362,278

[22] Filed: Dec. 22, 1994

[30] Foreign Application Priority Data

Dec. 27, 1993 [JP] Japan ..... 5-332391

[51] Int. Cl.[6] ..... B41F 31/03

[52] U.S. Cl. ..... 101/350

[58] Field of Search ..... 101/363, 350, 101/207–210, 119, 148, 364; 366/279, 282, 342, 343; 118/259

[56] References Cited

U.S. PATENT DOCUMENTS 3,747,084 7/1973 Hartung .

*Primary Examiner*—J. Reed Fisher
*Attorney, Agent, or Firm*—Kanesaka & Takeuchi

[57] ABSTRACT

A motor-type ink sensor for detecting ink in a printing device of a printing apparatus is formed of an agitating part disposed in a position of an ink fountain formed in the printing device, a motor for driving to rotate the agitating part, and a control section for detecting ink from the driving condition of the motor.

7 Claims, 8 Drawing Sheets

FIG. 10

| Measured temperature (℃) | Viscosity (×10³ [CPS]) |
|---|---|
| 11.4 | 50.0 |
| 23.7 | 35.8 |
| 29.8 | 30.6 |
| 42.3 | 25.2 |
| 50.3 | 22.0 |

FIG. 11

| Measured temperature (℃) | Viscosity (×10³ [CPS]) |
|---|---|
| 11.2 | 40.2 |
| 22.7 | 24.4 |
| 31.0 | 19.4 |
| 41.8 | 15.4 |
| 50.4 | 13.5 |

MOTOR-TYPE INK SENSOR

BACKGROUND OF THE INVENTION

1. Field of the Invention

The present invention relates to an ink detecting device useful for a printing apparatus such as a mimeograph apparatus and so forth, and more particularly to a motor-type ink sensor for detecting the presence or absence of ink by the driving condition of a motor which drives to rotate an agitating part in ink.

2. Description of the Related Art

As a means for detecting ink in a printing apparatus and so forth, an electrical capacitance ink detecting device as shown in FIG. 12 has been known. In this ink detecting device, an ink roller 100 and a squeegee roller 101, and an ink detecting electrode 103 which contacts an ink fountain defined therebetween serve as counter electrodes to constitute a capacitor. This capacitor and a coil not illustrated form an oscillatory circuit 104.

The oscillation frequency of the oscillatory circuit 104 is determined by the capacity of the capacitor when coil inductance is fixed. And the electrostatic capacity of the capacitor is determined by the quantity of ink. Therefore, the quantity of ink supplied between these rollers corresponds to the oscillation frequency of the oscillatory circuit 104, and the quantity of ink can be detected by use of this oscillation frequency.

According to the ink detecting device of electrostatic capacity type described above, it is imperative to accurately set the location of the detecting electrode 103 in relation to the rollers 100 and 101 in order to perform accurate ink detection. If the detecting electrode 103 is not accurately set, there will occur such a problem as inaccurate ink detection. Since there exists a limited space for mounting the detecting electrode within a narrow printing drum of the printing apparatus, the setting of the ink detecting device is much restricted.

SUMMARY OF THE INVENTION

It is therefore an object of the present invention to provide a motor-type ink sensor which can be easily set within a narrow printing drum of a printing apparatus and accurately detect the presence or absence of ink regardless of mounting accuracy.

The motor-type ink sensor of the first aspect of the invention is an ink sensor for detecting ink by a printing means of the printing apparatus, and has an agitating part disposed in the position of an ink fountain formed in the printing means, a motor for rotating the agitating part, and a control section for detecting ink from the driving condition of the motor.

The motor-type ink sensor of the second aspect of the present invention, as in the motor-type ink sensor of the first aspect of the present invention, also has the control section for determining the quantity of ink by detecting the driving condition of the motor from the load current of the motor which is driven at a rated or lower voltage.

The motor-type ink sensor of the third aspect of the present invention, as in the motor-type ink sensor of the second aspect of the present invention, is so designed that the control section outputs an "Empty" signal when the quantity of ink has been judged to be under a reference value, driving the ink supply section according to the "Empty" signal.

The motor-type ink sensor of the fourth aspect of the present invention, as in the motor-type ink sensor of the third aspect, is also so designed that the control section operates the ink supply section when the "Empty" signal and an "Enable" signal are entered into the control section.

The motor-type ink sensor of the fifth aspect of the present invention, as in the motor-type ink sensor of the second aspect, is provided with a restart signal generating circuit for restarting the motor from a stop.

The motor-type ink sensor of the sixth aspect of the present invention, as in the motor-type ink sensor of the fifth aspect, is of such a design that the restart signal generating circuit gives the motor a restart signal, which is stronger than the restart signal stated above, when the motor does not start if given a predetermined number of restart signals.

The motor-type ink sensor of the seventh aspect of the present invention, as in the motor-type ink sensor of sixth aspect, also has the restart signal generating circuit which gives the motor a stronger restart signal when the motor does not restart.

According to the aforementioned constitution, the motor at a stop is restarted by the input of the restart signal when ink runs out, thereby starting the rotation of the agitating part. At this time a very little load current is flowing in the motor, from which the absence of ink will be detected. With the supply of ink the quantity of ink reserved becomes large, and when the agitating part contacts ink, the motor being driven at a rated or less voltage easily stops. At this time a great load current is flowing in the motor, thereby detecting the presence of ink.

BRIEF DESCRIPTION OF THE DRAWINGS

FIG. 10 is a table showing a relationship between the temperature and viscosity of ink to be used on the squeegee roller in the embodiment;

FIG. 11 is a table showing a relationship between the temperature and viscosity of ink to be used on a squeegee blade in the embodiment.

DETAILED DESCRIPTION OF THE PREFERRED EMBODIMENT

Figure 1:
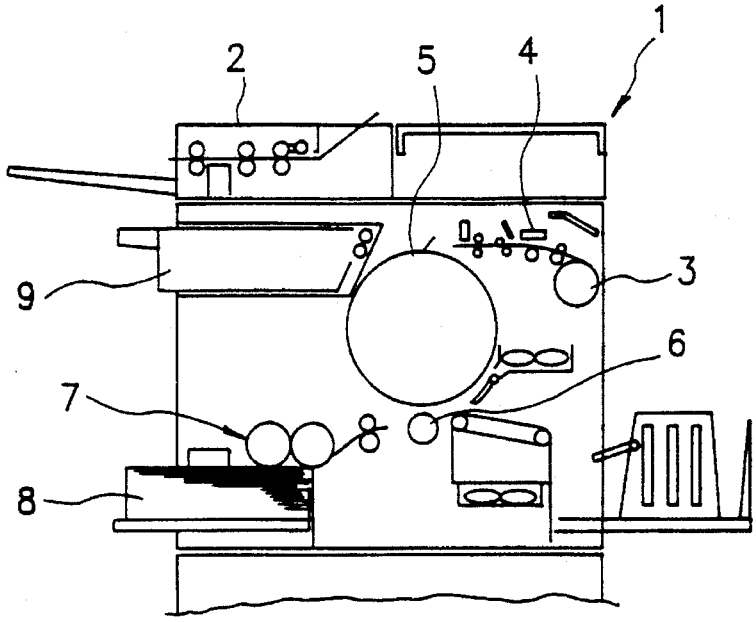
FIG. 1 is a sectional view of one embodiment of a mimeograph apparatus in which a motor-type ink sensor of the present invention is used.

FIG. 1 shows the internal construction of a mimeograph apparatus 1 in which a motor-type ink sensor of the first embodiment is mounted. The mimeograph apparatus 1 has an original image reading section 2 and a stencil preparing section 4 for forming a perforated image in a roll-type stencil paper 3 according to data from the reading section 2. Adjacently to the stencil preparing section 4 there is provided a cylindrical printing drum 5 as a printing means which is wrapped with the perforated stencil paper 3 on the outer peripheral surface and is driven to rotate. And inside the printing drum 5 are mounted an ink supply means, a liftable squeegee, etc. Furthermore, beneath the printing drum 5 are mounted a press roller 6 and a printing paper supply section 7, so that the printing paper 8 is fed in and the press roller 6 is moved up and down simultaneously with the rotation of the printing drum, thus performing mimeographing successively. A reference numeral 9 in the drawing refers to a stencil discharge box for holding a used stencil paper that has been stripped from the printing drum.

Figure 2:
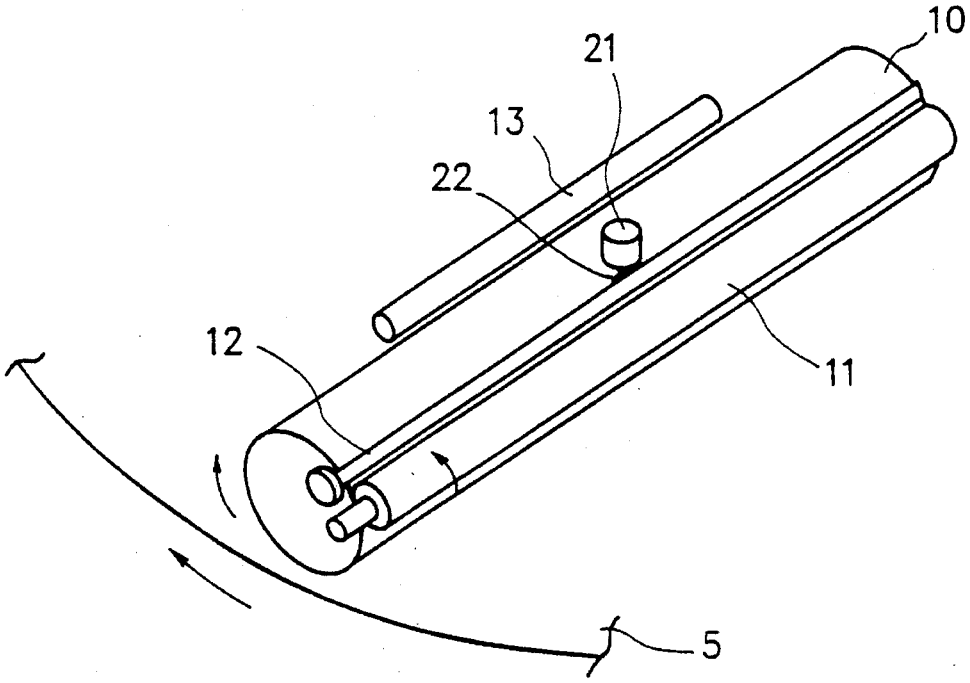
FIG. 2 is a perspective view showing the interior of a printing drum in the embodiment of the mimeograph apparatus.
Figure 3:
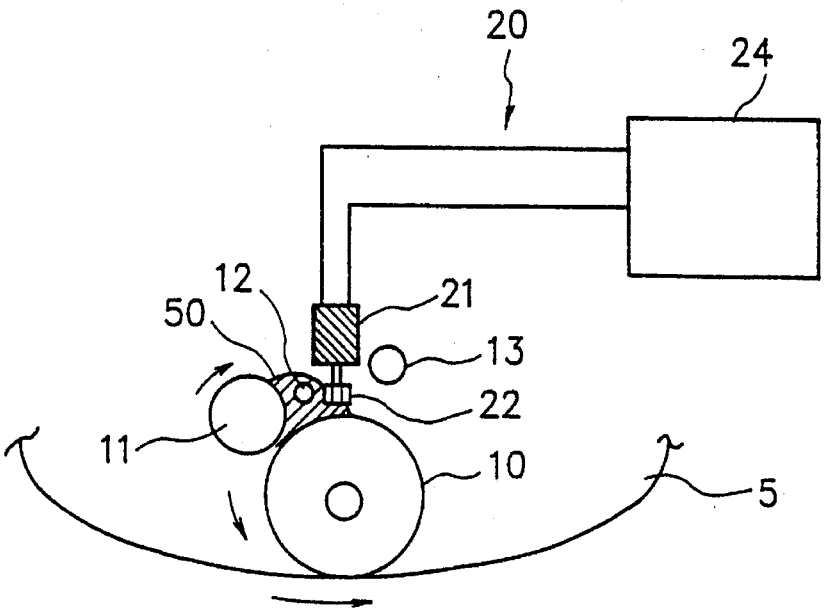
FIG. 3 is a sectional view showing the interior of the printing drum in the embodiment of the mimeograph apparatus.

FIGS. 2 and 3 show the interior of the printing drum 5 of the mimeograph apparatus 1. A squeegee roller 10 is mounted on the inner peripheral surface of the printing drum 5 at the bottom thereof. The outer peripheral surface of the squeegee roller 10 is in contact with the inner peripheral surface of the printing drum 5. In FIG. 3 a doctor roller 11 is disposed parallel to and slightly spaced from the squeegee roller 10 leftwardly, in the printing drum 5 which rotates in the counterclockwise direction. In the vicinity of the squeegee roller 10 and the doctor roller 11 a driving rod 12 is rotatably mounted in parallel with the rollers 10 and 11. Also, a little above the right-hand side of the squeegee roller 10 is mounted an ink distributor 13 which communicates with the ink supply means. Ink supplied from the ink distributor 13 forms an ink fountain 50 between the squeegee roller 10 and the doctor roller 11, which is agitated by the driving rod 12.

Above the top of the squeegee roller 10 is mounted a sensor motor 21 of a motor-type ink sensor 20 with its rotating shaft directed toward the squeegee roller 10. On the forward end of the rotating shaft of the sensor motor 21 is installed an agitating part 22. This agitating part 22 is disposed on the right of the driving rod 12, that is, in a position corresponding to the right-hand end of the ink fountain 50. The agitating part 22 can be disposed in other position, that is, above the driving rod 12. The sensor motor 21 is connected to a control section 24.

The control section 24 has a function to judge the presence and absence of ink by detecting the driving condition of the sensor motor 21 from the load current of the sensor motor 21 which is driven at a rated or lower voltage. The motor-type ink sensor 20, which will be described in detail later, has the agitating part 22 which is driven by the sensor motor 21, in the vicinity of the ink fountain 50, for the purpose of monitoring the load which the sensor motor 21 receives from ink in order to detect ink while comparing the load with a reference value. That is, the motor-type ink sensor 20 has such a constitution that when no ink is present, the sensor motor 21 turns, and when a specific amount of ink is present, ink holds on the agitating part 22 to thereby stop the sensor motor 21; and with the supply of a start signal to the sensor motor 21 at a specific time interval, the sensor motor 21 that has once stopped restarts operating.

Figure 4:
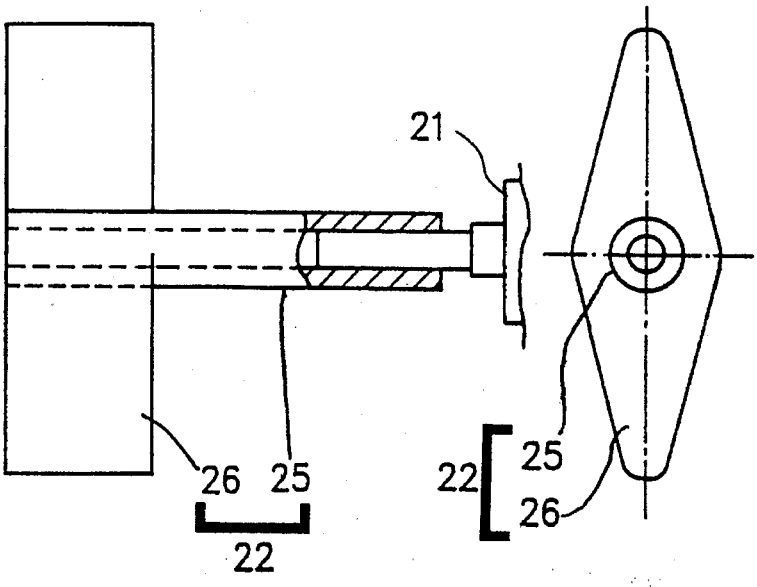
FIG. 4 are front and right side views showing an agitating part of the motor-type ink sensor in the embodiment.

The agitating part 22 of the motor-type ink sensor 20, as shown in FIG. 4, comprises a center shaft 25 and a blade section 26. On the base end of the center shaft 25 the rotating shaft of the sensor motor 21 is mounted by pressing. The length of the center shaft 25 is set in order that a distance from the top end of the blade section 26 to the bottom surface of the sensor motor 21 will be around twice as large as the height of blade section 26. If the distance between the agitating part 22 and the sensor motor 21 is small, ink will attach between the agitating part 22 and the sensor motor 21, resulting in hard restart of the sensor motor 21. In the present embodiment, however, the agitating part is provided with a long center shaft 25 and ink attaches only on the agitating part 22; therefore a greater resistance than needed will not be applied to the rotation of the sensor motor 21 by the ink holding on the agitating part 22.

The blade section 26 has two blades each having smooth surfaces with little irregularities. Therefore, there will not occur such a trouble that an unnecessary amount of ink attaches to, and is held on, the blade surface and between the blades, and accordingly the restart of the sensor motor 21 from a stop will not be interrupted. Since the center shaft 25 and the blade section 26 are formed of a light-weight resinous material, for example, polyacetal and ABS resin, which will not give an adverse effect to the rotation of the sensor motor 21, the sensor motor 21 which is driven at a rated or lower voltage receives a great deal of load owing to the adhesion of ink, thus causing a current variation.

Next, the circuit formation of the sensor motor 21 and the control section 2 in the motor-type ink sensor 20 will be explained by referring to FIG. 5.

The sensor motor 21 is a miniature d.c. motor, which, in the present embodiment, is driven at a rated or lower voltage. The current flowing into the sensor motor 21 is amplified by an amplifier 30 through a waveform shaping circuit 31 after conversion to a voltage through a current-voltage conversion circuit, and then is inputted to a comparing section 32, where the voltage is compared with a reference voltage not shown which is applied to the comparing section 32. If the voltage of the sensor motor 21 is less than the reference voltage, an "Empty" signal will be outputted.

That is, when no ink is present (or the remaining amount of ink is less than the reference value), ink will not attach to the blade section 26 of the agitating part 22, and therefore the sensor motor 21 can be kept running at the rated or lower voltage; however, when ink supplied attaches to the blade section 26, the sensor motor 21 receives load and the load current rises. An increase in the voltage caused by the rise of the load is compared with the reference voltage by the comparing section 32, thereby detecting the occurrence of load caused by the adhesion of ink.

The "Empty" signal is inputted into an AND circuit 33. To this AND circuit 33 an "Enable" signal is also inputted. The "Enable" signal is a signal which allows the start of ink supply. In the mimeograph apparatus 1, it is not necessarily permitted to supply ink at any time if little amount of ink remains, for example no ink supply is required during stencil preparation and during a stop of the apparatus. The "Enable" signal is produced and inputted to the AND circuit 33 so that when ink supply is needed, for example only when the printing drum 5 rotates to supply a printing paper 8 during printing, ink supply will be permitted. Where ink detection is not needed, for example when the printing drum 5 is not rotating, the sensor motor may be stopped.

A drive signal is outputted only when both the "Empty" signal and the "Enable" signal have been entered into the AND circuit 33. As shown in FIG. 5, the drive signal is inputted into the driving section 34, which in turn drives a pump motor 35 to supply ink.

The sensor motor 21, when once stopped by ink supplied, will remain stationary even when the ink is used out, resulting in a failure in detecting the absence of ink. Therefore, as shown in FIG. 5, the sensor motor 21 is designed such that a restart signal will be inputted at a specific cycle.

Figure 5:
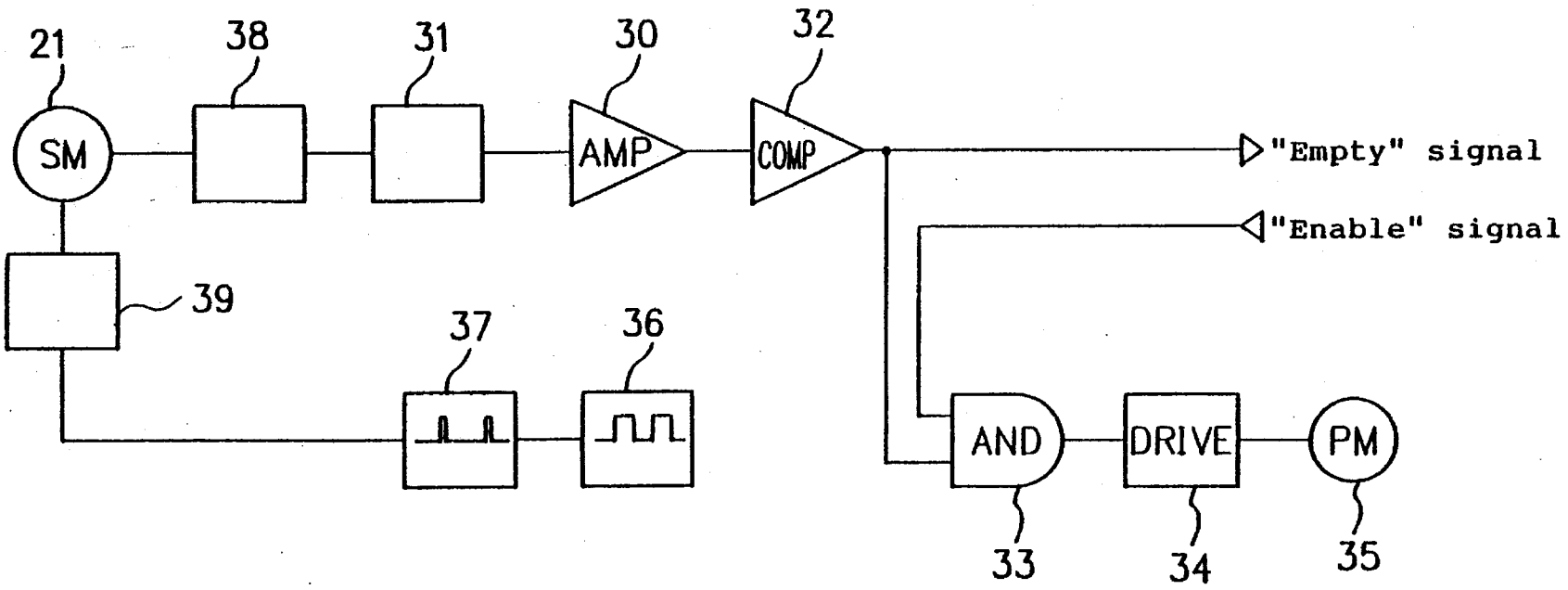
FIG. 5 is a block diagram showing the constitution of the motor-type ink sensor and a control section in the embodiment.

In FIG. 5, a reference numeral 36 denotes a restart signal generating circuit, such as a multivibrator, which generates a short wave with a specific period. In the present embodiment, the multivibrator generates a short wave with a period of three seconds. A reference numeral 37 denotes a restart switching circuit which generates a pulse-type restart signal by catching the edge of rise or fall of the short wave from the restart signal generating circuit 36. In the present embodiment, the length of the restart signal is set at 250 msec. The restart signal produced from the restart switching circuit 37 is fed to a motor driving circuit 39, thus driving the sensor motor 21.

When the restart signal is fed into the sensor motor, the voltage applied to the sensor motor 21 also increases. However, there will never occur such a misjudgment that, with the application of the pulse-type high voltage to the sensor motor 21, the sensor motor 21 is loaded and decides as if ink were present in the printing drum notwithstanding the absence of ink. It is because the pulse-type voltage of the sensor motor 21 generated by the restart signal is changed in waveform by means of the waveform shaping circuit 31 and becomes less than the reference voltage at the comparing section 32.

In the motor-type ink sensor of the aforesaid constitution, when ink to be supplied is not present in an ink reservoir, ink supply will fail if the pump motor 35 is driven in an attempt to supply ink when required as a result of ink detection in the printing drum 5. Therefore, the sensor motor 21 keeps on rotating. When the "Empty" signal has been successively outputted for at least an arbitrarily set specific period of time, the absence of ink may be decided and displayed on a control panel not shown of the mimeograph apparatus 5.

Figure 6:
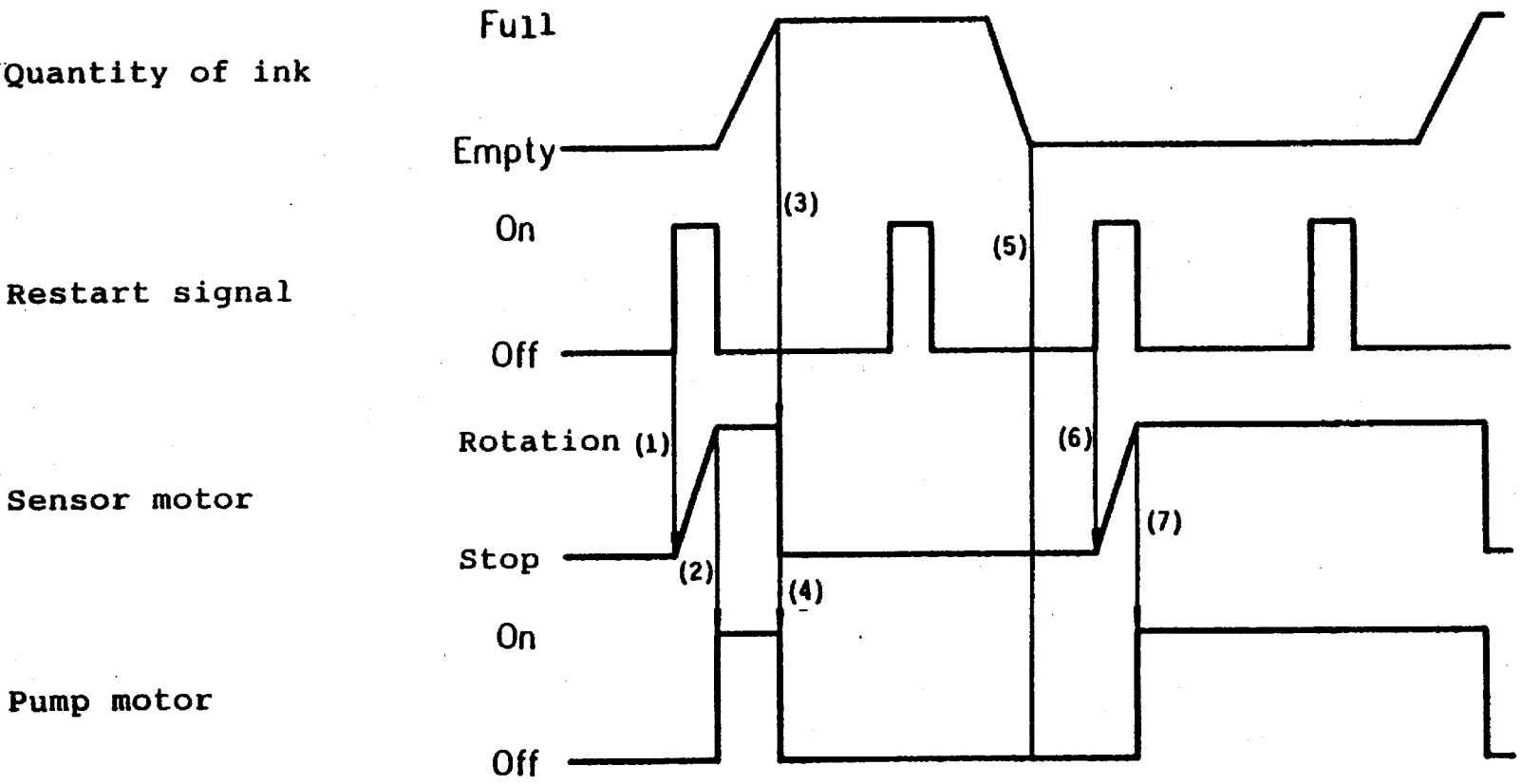
FIG. 6 is a timing chart showing an operation timing of the motor-type ink sensor and the control section thereof in the embodiment.

Next, the operation timing of the sensor motor 21 and the control section 24 in the motor-type ink sensor 20 will be explained with reference to FIG. 6. In the explanation, it is assumed that an "Enable" signal has been outputted.

In (1) when a restart signal is inputted into the sensor motor 21 in such a condition that the quantity of ink is under a specified quantity ("Empty" level in the drawing), the sensor motor 21 starts rotation shown in (2).

With the rotation of the sensor motor 21 as shown in (2), the Empty signal is outputted at the time of start of rotation, and the pump motor 35 is turned on to start supplying the ink.

When the quantity of ink exceeds a specified quantity ("Full" level in the drawing) as shown in (3), the blade section 26 of the agitating part 22 will be loaded with ink to stop the sensor motor 21, whereby no Empty signal will be outputted; therefore, as shown in (4), the pump motor 35 also will be stopped.

The restart signal is continuously fed to the sensor motor 21 with a specific period also while the specified quantity of ink is present. The quantity of ink will soon decrease again to the specified quantity or less as shown in (5). The sensor motor 21 restarts operation as shown in (6) according to the first restart signal after the decrease of the ink quantity to the specified quantity or less. Then, with the rotation of the sensor motor 21, the pump motor 35 is driven as shown in (7).

Figure 7:
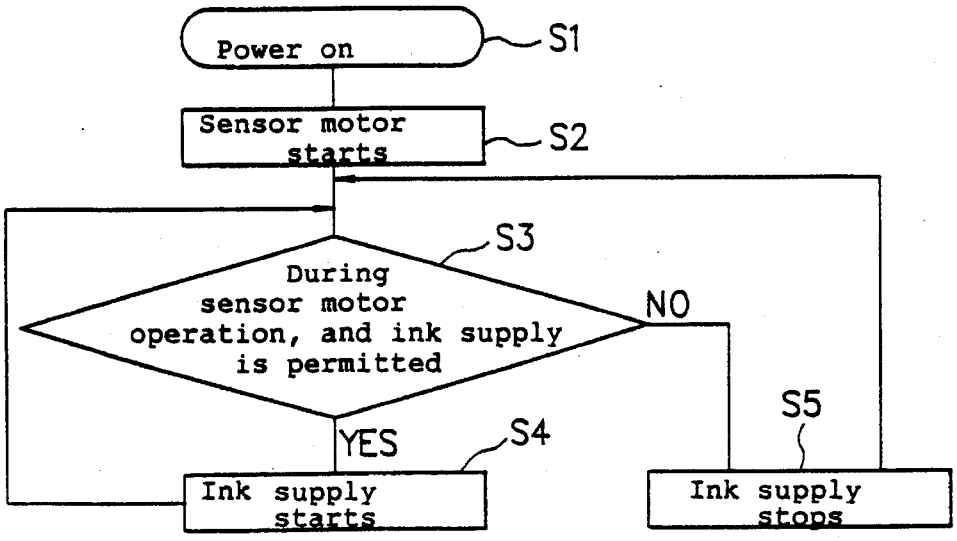
FIG. 7 is a flow chart showing the operation of the embodiment.

According to the operation timing explained above, there can be obtained an operation sequence of the mimeograph apparatus 1 as shown in FIG. 7. That is, at Step 1, when the whole body of the mimeograph apparatus 1 is turned on, the sensor motor 21 as shown at Step 2 will start.

Then, as shown at Step 3, the pump motor 35 will be driven to start the supply of ink as shown at Step 4 only when the sensor motor 21 is rotating (an Empty signal is present) and ink supply is permitted (an "Enable" signal is present).

At Step 3, the pump motor 35 is stopped to stop ink supply as shown at Step 5 when the sensor motor 21 is not rotating (the Empty signal is not present) and ink supply is not permitted (the "Enable" signal is not present).

Figure 8:
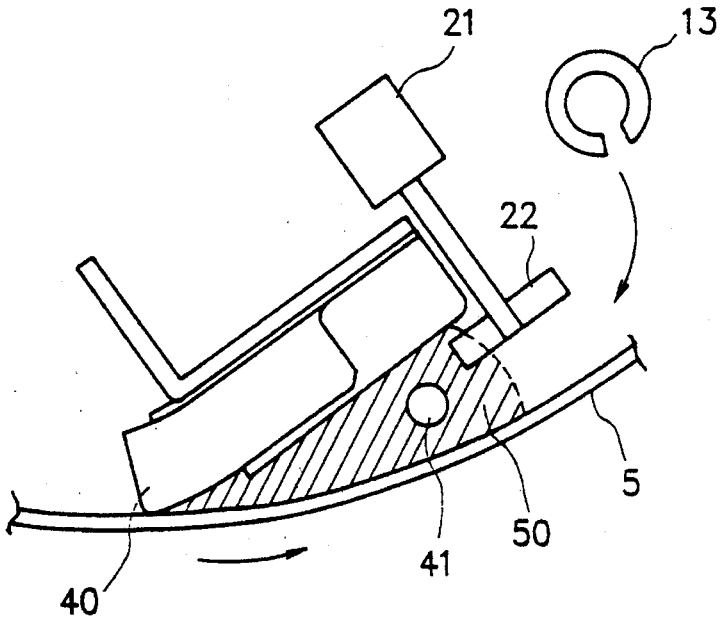
FIG. 8 is a sectional view showing another example of a squeegee device in the embodiment.

The embodiment explained above pertains to the mimeograph apparatus 1 having the squeegee roller 10 in the printing drum 5 as shown in FIG. 3, but the constitution of the squeegee device in the printing drum 5 may be one as shown in FIG. 8.

The squeegee device shown in FIG. 8 is of such a construction that an elastic plate-like squeegee blade 40 is moved up and down, by means of a lift driving mechanism not shown, into contact with the inner peripheral surface of the printing drum 5 to thereby force ink out of the printing drum. In relation to this squeegee blade 40, the ink distributor 13 is disposed adjacent to the advance side in the direction of rotation of the printing drum 5 indicated by an arrow. Ink supplied from the ink distributor 13 gathers between the squeegee blade 40 and the inner peripheral surface of the printing drum 5. In this ink fountain 50 is provided an agitating rod 41 in parallel with the longitudinal direction of the squeegee blade 40, for agitating the ink in the fountain 50.

With respect to the constitution of the squeegee device stated above, the sensor motor 21 of the motor-type ink sensor 20 is disposed in the vicinity of the edge of the squeegee blade 40 near the distributor 13 as shown in FIG. 8. Here, the agitating part 22 is disposed to the right in the drawing of the agitating rod 41, that is, in a position corresponding to the right-hand end of the ink fountain 50 apart from the contact section between the squeegee blade 40 and the printing drum 5.

Next, the supply of the restart signal to the sensor motor 21 will be explained.

The sensor motor 21 is for detecting load according to the viscosity of ink; the ink viscosity differs with the type of the ink and environmental temperatures. Therefore, when ink attaches between the agitating part 22 and the sensor motor 21, it is necessary to give a restart signal, for restarting the sensor motor 21 that has once stopped, in accordance with the viscosity of ink remaining between the agitating part 22 and the sensor motor 21, and to restart exactly in such a state that there remains no ink in the ink fountain.

For example, if the sensor motor 21 does not restart when supplied with a common restart signal, it is conceivable that the ink viscosity is greater than an assumed value. In this case, as shown for example in FIG. 9(*a*), it is advised to give a restart signal SG2 of greater strength after repeating the restart signal SG1 several times.

To increase the strength of the signal, the length of time to apply the signal may be increased or the voltage value or current value may be increased. Also both the time and voltage value (or the current value) may be increased.

Figure 9:
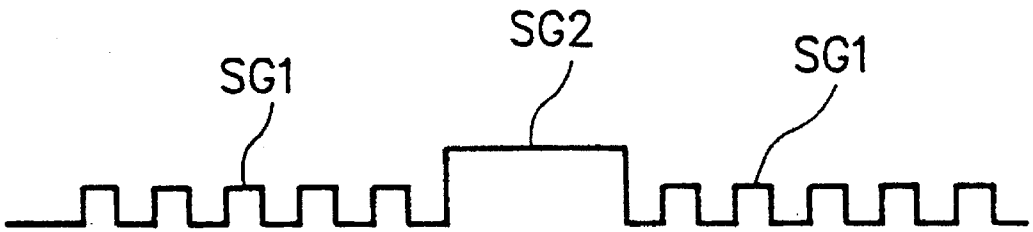
FIGS. 9*a* and 9*b* are timing charts exemplifying a method of supplying a restart signal in the embodiment.
Figure 9:
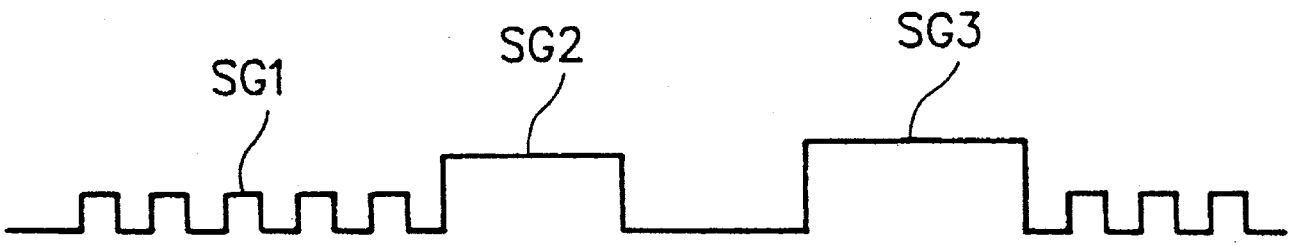
Figure 12:
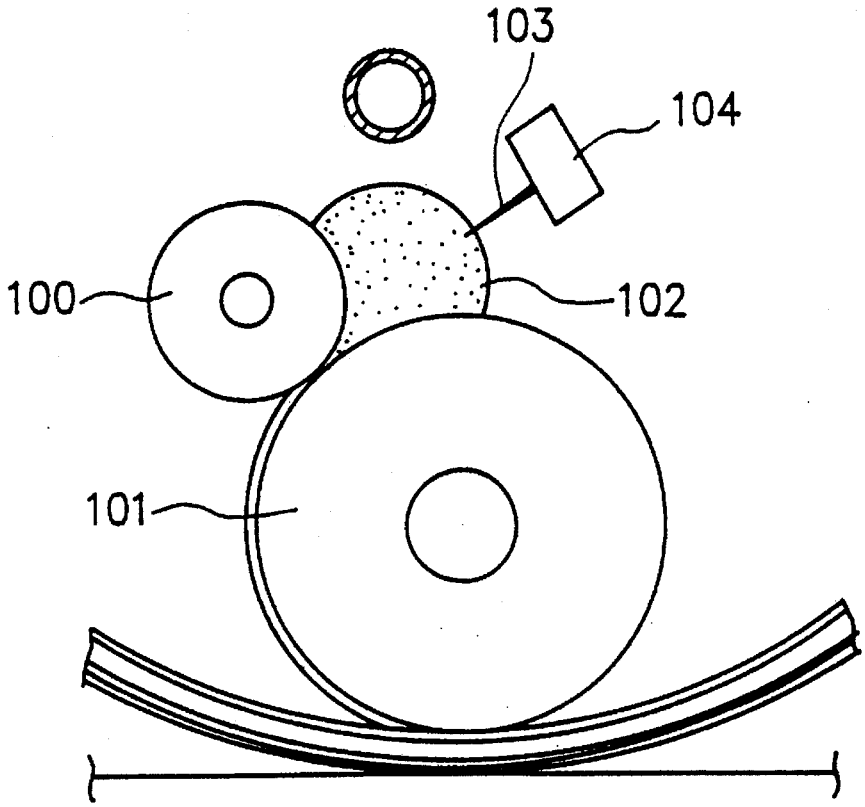
FIG. 12 Prior Art
FIG. 12 is a sectional view showing a conventional electrostatic capacity type ink detecting device.

In case the sensor motor 21 will not restart even when supplied with a restart signal SG2 of greater strength, it is sufficient to supply a stronger restart signal SG3 as shown for example in FIG. 9(*b*).

Also, when the sensor motor 21 is restarted by giving a restart signal SG2 of greater strength than the common restart signal SG1, the common restart signal SG1 is then supplied to judge if the sensor motor 21 operates or not. When the sensor motor 21 does not turn if supplied with the restart signal SG2, a greater restart signal may be supplied to judge if the sensor motor 21 operates as shown in FIG. 9(*b*).

Furthermore, as described above, the agitating part 22 driven by the sensor motor 21 of the present embodiment is so constituted that the ink does not unnecessarily adhere thereon, but a stronger signal may be given to the sensor motor 21 for the purpose of removing the ink off from the agitating part 22 once in a while.

FIG. 10 shows the ink viscosity by the temperature of ink applied to the squeegee roller 10. FIG. 11 shows the ink viscosity by the temperature of ink applied to the squeegee blade 40. Since it is conceivable that the greater the ink viscosity, the stronger the restart signal is required; therefore, the ink sensor may be so constituted that the strength of the aforesaid restart signal will be automatically adjustable in accordance with data on the ink viscosity stated above.

That is, the ink sensor may be provided with a temperature measuring means, a control means operating on the data of ink viscosity relative to temperature, and a means for adjusting a pulse width and generating interval of the restart signal, to thereby produce the restart signal of proper pulse width and at a proper generating interval corresponding to an actual ink viscosity.

According to the motor-type ink sensor 20 of the present embodiment, the following effect can be obtained as explained above. First, the sensor motor 21 is driven with a rated or lower voltage and therefore is usable for a longer life as compared with that used at a rating.

The arrangement of the sensor motor 21 for detecting the presence or absence of ink is restricted less than the prior art electrostatic capacity type ink detecting device which is restricted largely with the arrangement of the detecting electrode. The control section 24 can be disposed outside of the printing drum 5.

In the embodiment heretofore explained, the presence or absence of ink is detected by the rotation or stop of rotation of the sensor motor 21. And therefore it is possible to gradually detect the quantity of ink by gradually judging the load current of the sensor motor 21.

According to the motor-type ink sensor of the present invention, ink is detected from the driving condition of the motor equipped with the agitating part disposed in the vicinity of the ink fountain; and therefore it is possible to easily set the ink sensor inside of a narrow printing drum of a printing apparatus, and moreover can accurately detect the presence or absence of ink regardless of a mounting accuracy.

What is claimed is:

1. An ink sensor for detecting ink in an ink fountain formed in printing means of a printing apparatus, comprising, an agitating portion disposed in the ink fountain, a motor connected to the agitating portion for rotating the same, power supply means electrically connected to the motor for rotating the motor, means for providing a predetermined first electrical reference value, and a comparing section electrically connected to the motor and the means for providing the predetermined first reference value, said comparing section receiving electricity supplied to the motor from the power supply means and the first reference value and comparing said electricity and said first reference value, said comparing section outputting an ink empty signal for the ink fountain when the electricity supplied to the motor is less than the first reference value.

2. An ink sensor according to claim 1, wherein said power supply means includes means for supplying to the motor a first electric value greater than the first reference value due to resistance of ink relative to the agitating portion when an amount of ink in the ink fountain is more than a predetermined level so that the comparing section does not output the ink empty signal, and means for supplying to the motor a second electric value less than the first reference value due to resistance of ink relative to the agitating portion when an amount of ink in the ink fountain is less than the predetermined level so that the comparing section outputs the ink empty signal.

3. An ink sensor according to claim 2, wherein said printing apparatus includes an ink supply section for supplying ink to the ink fountain when the ink empty signal is outputted from the comparing section.

4. An ink sensor according to claim 3, further comprising enabling signal generating means connected to the printing apparatus for generating an ink enabling signal, and an AND circuit connected to the enabling signal generating means and the comparing section, said AND circuit outputting a signal for actuating the ink supply section to supply ink to the ink fountain when the AND circuit receives the ink enabling signal from the enabling signal generating means and the ink empty signal from the comparing section.

5. An ink sensor according to claim 4, wherein said power supply means includes a restart signal generating circuit for cyclically generating signals, and a restart switching circuit electrically connected to the restart signal generating circuit and the motor, said restart switching circuit, upon receipt of a signal from the restart signal generating circuit, generating a motor restart signal and supplying the motor restart signal to the motor so that the motor starts to rotate in case the motor stopped and the agitating portion contacts ink in the ink fountain.

6. An ink sensor according to claim 5, wherein said restart switching circuit includes means for generating a normal restart signal and means for generating a strong restart signal stronger than the normal restart signal, said strong restart signal being generated if the motor does not start by the normal restart signal.

7. An ink sensor according to claim 6, wherein said means for generating the strong restart signal includes means for generating a signal stronger than a precedent signal so that strength of the signal gradually increases.

* * * * *